US010803847B1

(12) United States Patent
Delaney et al.

(10) Patent No.: US 10,803,847 B1
(45) Date of Patent: Oct. 13, 2020

(54) AUTHORIZED SOUND NOTIFICATION DURING NOISE CANCELLATION CONTEXT

(71) Applicant: Lenovo (Singapore) Pte. Ltd., Singapore (SG)

(72) Inventors: Mark Patrick Delaney, Raleigh, NC (US); Nathan J. Peterson, Oxford, NC (US); Russell Speight VanBlon, Raleigh, NC (US); Arnold S. Weksler, Raleigh, NC (US); John Carl Mese, Cary, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 16/541,733

(22) Filed: Aug. 15, 2019

(51) Int. Cl.
*G10K 11/178* (2006.01)
*G10L 25/51* (2013.01)

(52) U.S. Cl.
CPC .. *G10K 11/17827* (2018.01); *G10K 11/17823* (2018.01); *G10L 25/51* (2013.01); *G10K 2210/1081* (2013.01)

(58) Field of Classification Search
None
See application file for complete search history.

(56) References Cited

U.S. PATENT DOCUMENTS

2015/0222977 A1* 8/2015 Angel, Jr. ..... H04R 1/105 381/74
2019/0098395 A1* 3/2019 Keeling ..... G10K 11/17823

* cited by examiner

*Primary Examiner* — Kenny H Truong
(74) *Attorney, Agent, or Firm* — Ference & Associates LLC

(57) ABSTRACT

One embodiment provides a method, including: activating, on an information handling device, a noise cancelling setting; recording, using a microphone associated with the information handling device, ambient audio; determining, using a processor, whether an authorized sound is present in the recorded ambient audio; and notifying, responsive to determining that an authorized sound is present in the recorded ambient audio, a user of the authorized sound. Other aspects are described and claimed.

16 Claims, 3 Drawing Sheets

AUTHORIZED SOUND NOTIFICATION DURING NOISE CANCELLATION CONTEXT

BACKGROUND

Individuals utilize their information handling devices ("devices"), for example, smart phones, tablet devices, laptop and/or personal computers, and the like, in various different contexts throughout the day. For example, an individual may listen to music on their smart phone while walking on the street or conduct work on their laptop in a public setting. Oftentimes, individuals may hear various types of ambient sounds while engaged with their devices (e.g., other individuals talking, sounds from nature, sounds produced by other devices or machines, etc.). Accordingly, individuals employ a variety of different techniques to minimize the interruptive effect of ambient sound during device interaction.

BRIEF SUMMARY

In summary, one aspect provides a method, comprising: activating, on an information handling device, a noise cancelling setting; recording, using a microphone associated with the information handling device, ambient audio; determining, using a processor, whether an authorized sound is present in the recorded ambient audio; and notifying, responsive to determining that an authorized sound is present in the recorded ambient audio, a user of the authorized sound.

Another aspect provides an information handling device, comprising: a microphone; a processor; a memory device that stores instructions executable by the processor to: activate a noise cancelling setting; record, using the microphone, ambient audio; determine whether an authorized sound is present in the recorded ambient audio; and notify, responsive to determining that the authorized sound is present in the recorded ambient audio, a user of the authorized sound.

A further aspect provides a product, comprising: a storage device that stores code, the code being executable by a processor and comprising: code that activates a noise cancelling setting; code that records ambient audio; code that determines whether an authorized sound is present in the recorded ambient audio; and code that notifies, responsive to determining that the authorized sound is present in the recorded ambient audio, a user of the authorized sound.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
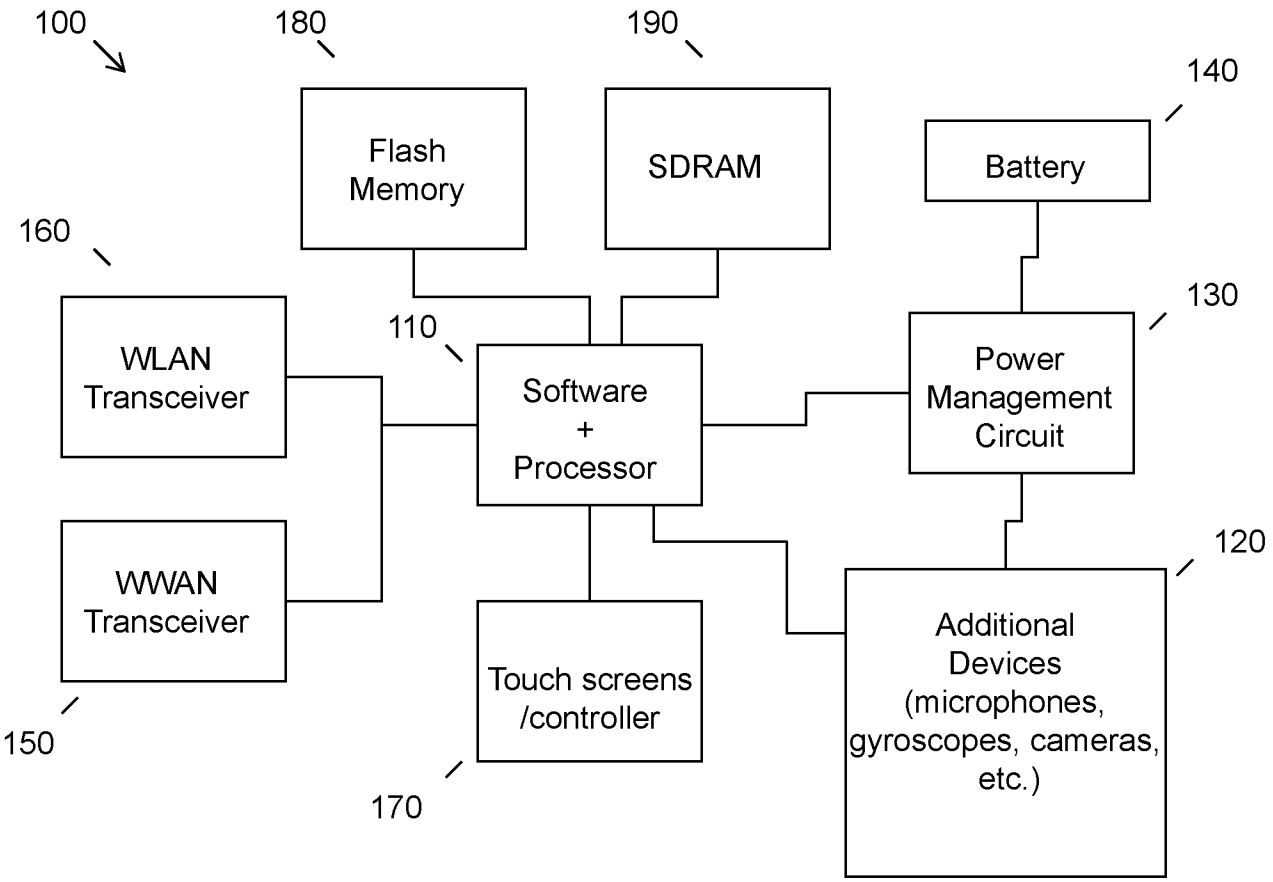
FIG. 1 illustrates an example of information handling device circuitry.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

The presence of ambient sounds, or background noise, in a user's environment may interfere with the user's ability to effectively engage with their device and/or to perform certain types of tasks. As users frequently interact with their devices in public, or otherwise noisy, settings, some types of ambient sounds will inevitably be present. For example, many modern offices have transitioned to an open-style landscape in which workers are seated in close proximity to one another and/or are not separated by walled partitions. In these layouts, noise produced by other individuals may be easily heard by the user. As another example, users interacting with their devices at home may be subject to conventional noises commonly associated with the home (e.g., children playing, lawnmower running, washing machine and/or dishwasher working, television sounds, etc.).

Other than relocating to a different location, a common solution employed by many users to minimize the interruptive effect of ambient sounds is to wear headphones (e.g., noise-cancelling headphones, etc.). Advances in technology have led to the development of active noise control (ANC), also known as noise cancellation or active noise reduction. These techniques reduce unwanted sound through the addition of a second sound specifically designed to cancel the first. Such techniques have become increasingly popular and are commonly employed by students and/or other individuals engaged in deep work or traveling.

However, conventional ANC solutions are binary in that the noise is either cancelled or it is not cancelled. Accordingly, when a user is engaged in a noise cancellation context, they may miss important sounds that they may have wanted to hear. For example, a user may want to always be apprised of comments provided by certain individuals (e.g., a boss, a spouse, etc.) or noises associated with different events (e.g., a fire alarm, etc.). When these desired sounds are missed, a poor user experience may result.

Accordingly, an embodiment provides a method for apprising a user of authorized sounds while the user is engaged in a noise cancellation context. In an embodiment, a noise cancellation setting may be activated on a device. The noise cancellation setting may be activated manually (e.g., by the user, etc.) or may be always active by virtue of the device utilized (e.g., active ANC headphones, etc.). An embodiment may also utilize a microphone to record ambient audio in the user's environment. Thereafter, an embodiment may determine whether one or more sounds in the recorded ambient audio are associated with authorized sounds (e.g., sounds originating from authorized individuals, devices, programs, etc.). Responsive to arriving at a positive determination, an embodiment may notify the user of these authorized sounds. For example, an embodiment may replay the authorized sound to the user on a short delay. Such a method may keep a user apprised of desired sounds while still effectively blocking out unwanted noise.

The illustrated example embodiments will be best understood by reference to the figures. The following description is intended only by way of example, and simply illustrates certain example embodiments.

While various other circuits, circuitry or components may be utilized in information handling devices, with regard to smart phone and/or tablet circuitry 100, an example illustrated in FIG. 1 includes a system on a chip design found for example in tablet or other mobile computing platforms. Software and processor(s) are combined in a single chip 110. Processors comprise internal arithmetic units, registers, cache memory, busses, I/O ports, etc., as is well known in the art. Internal busses and the like depend on different vendors, but essentially all the peripheral devices (120) may attach to a single chip 110. The circuitry 100 combines the processor, memory control, and I/O controller hub all into a single chip 110. Also, systems 100 of this type do not typically use SATA or PCI or LPC. Common interfaces, for example, include SDIO and I2C.

There are power management chip(s) 130, e.g., a battery management unit, BMU, which manage power as supplied, for example, via a rechargeable battery 140, which may be recharged by a connection to a power source (not shown). In at least one design, a single chip, such as 110, is used to supply BIOS like functionality and DRAM memory.

System 100 typically includes one or more of a WWAN transceiver 150 and a WLAN transceiver 160 for connecting to various networks, such as telecommunications networks and wireless Internet devices, e.g., access points. Additionally, devices 120 are commonly included, e.g., an image sensor such as a camera, audio capture device such as a microphone, motion sensor such as an accelerometer or gyroscope, etc. System 100 often includes one or more touch screens 170 for data input and display/rendering. System 100 also typically includes various memory devices, for example flash memory 180 and SDRAM 190.

Figure 2:
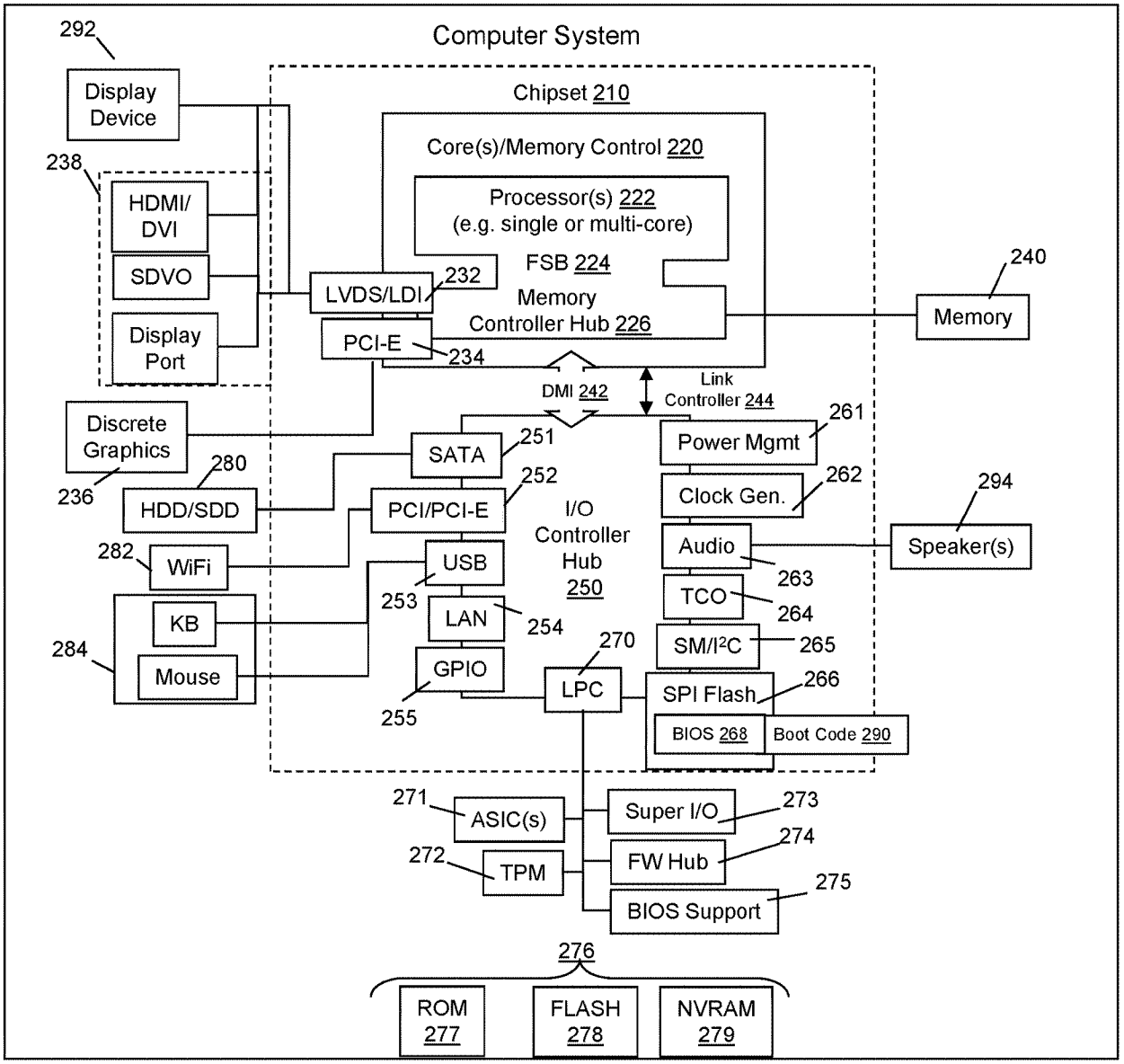
FIG. 2 illustrates another example of information handling device circuitry.

FIG. 2 depicts a block diagram of another example of information handling device circuits, circuitry or components. The example depicted in FIG. 2 may correspond to computing systems such as the THINKPAD series of personal computers sold by Lenovo (US) Inc. of Morrisville, N.C., or other devices. As is apparent from the description herein, embodiments may include other features or only some of the features of the example illustrated in FIG. 2.

The example of FIG. 2 includes a so-called chipset 210 (a group of integrated circuits, or chips, that work together, chipsets) with an architecture that may vary depending on manufacturer (for example, INTEL, AMD, ARM, etc.). INTEL is a registered trademark of Intel Corporation in the United States and other countries. AMD is a registered trademark of Advanced Micro Devices, Inc. in the United States and other countries. ARM is an unregistered trademark of ARM Holdings plc in the United States and other countries. The architecture of the chipset 210 includes a core and memory control group 220 and an I/O controller hub 250 that exchanges information (for example, data, signals, commands, etc.) via a direct management interface (DMI) 242 or a link controller 244. In FIG. 2, the DMI 242 is a chip-to-chip interface (sometimes referred to as being a link between a "northbridge" and a "southbridge"). The core and memory control group 220 include one or more processors 222 (for example, single or multi-core) and a memory controller hub 226 that exchange information via a front side bus (FSB) 224; noting that components of the group 220 may be integrated in a chip that supplants the conventional "northbridge" style architecture. One or more processors 222 comprise internal arithmetic units, registers, cache memory, busses, I/O ports, etc., as is well known in the art.

In FIG. 2, the memory controller hub 226 interfaces with memory 240 (for example, to provide support for a type of RAM that may be referred to as "system memory" or "memory"). The memory controller hub 226 further includes a low voltage differential signaling (LVDS) interface 232 for a display device 292 (for example, a CRT, a flat panel, touch screen, etc.). A block 238 includes some technologies that may be supported via the LVDS interface 232 (for example, serial digital video, HDMI/DVI, display port). The memory controller hub 226 also includes a PCI-express interface (PCI-E) 234 that may support discrete graphics 236.

In FIG. 2, the I/O hub controller 250 includes a SATA interface 251 (for example, for HDDs, SDDs, etc., 280), a PCI-E interface 252 (for example, for wireless connections 282), a USB interface 253 (for example, for devices 284 such as a digitizer, keyboard, mice, cameras, phones, microphones, storage, other connected devices, etc.), a network interface 254 (for example, LAN), a GPIO interface 255, a LPC interface 270 (for ASICs 271, a TPM 272, a super I/O 273, a firmware hub 274, BIOS support 275 as well as various types of memory 276 such as ROM 277, Flash 278, and NVRAM 279), a power management interface 261, a clock generator interface 262, an audio interface 263 (for example, for speakers 294), a TCO interface 264, a system management bus interface 265, and SPI Flash 266, which can include BIOS 268 and boot code 290. The I/O hub controller 250 may include gigabit Ethernet support.

The system, upon power on, may be configured to execute boot code 290 for the BIOS 268, as stored within the SPI Flash 266, and thereafter processes data under the control of one or more operating systems and application software (for example, stored in system memory 240). An operating system may be stored in any of a variety of locations and accessed, for example, according to instructions of the BIOS 268. As described herein, a device may include fewer or more features than shown in the system of FIG. 2.

Information handling device circuitry, as for example outlined in FIG. 1 or FIG. 2, may be used in devices such as noise cancelling headphones or headsets and/or other electronic devices that may be able to record and simultaneously block ambient audio. For example, the circuitry outlined in FIG. 1 may be implemented in a headset embodiment, whereas the circuitry outlined in FIG. 2 may be implemented in a laptop.

Figure 3:
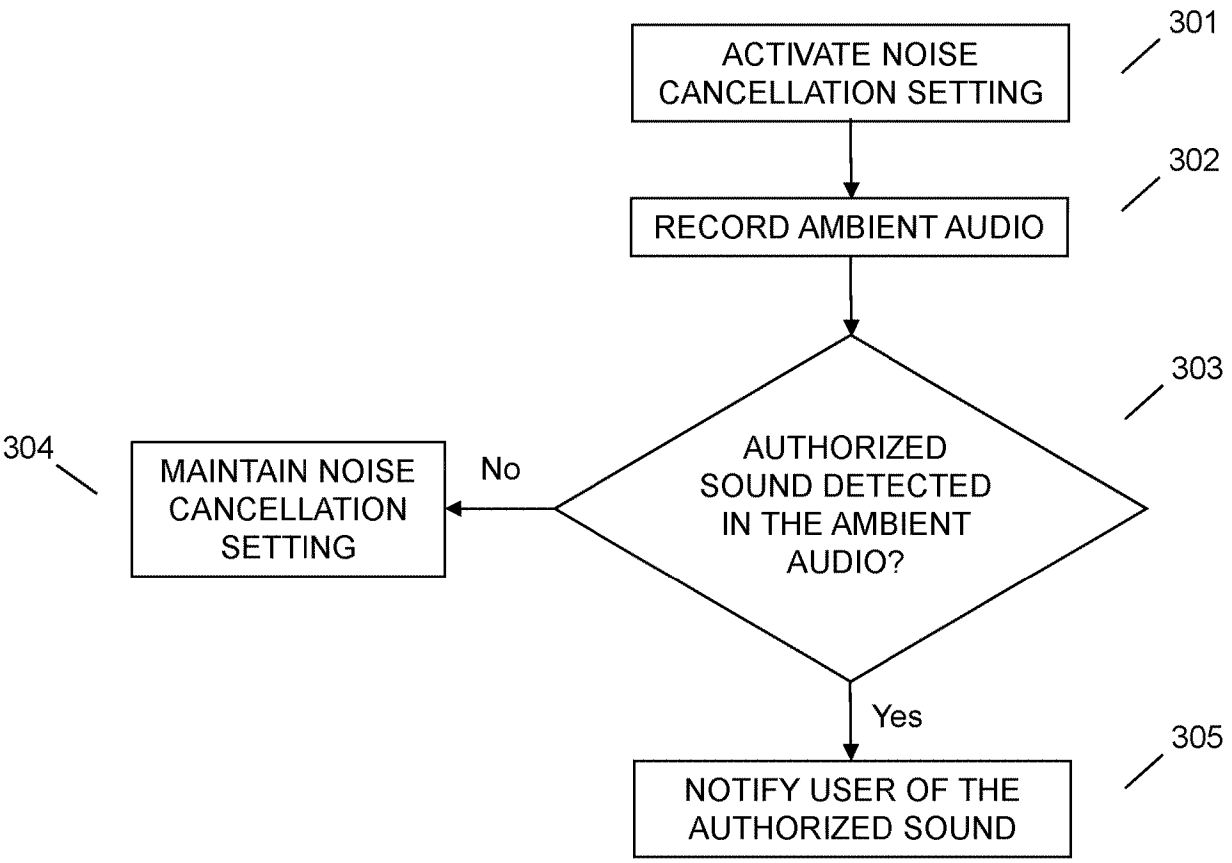
FIG. 3 illustrates an example method of notifying a user of authorized sounds while the user is associated with a noise cancellation context.

Referring now to FIG. 3, an embodiment may identify authorized sounds in ambient noise and may thereafter apprise a user as to the presence of these authorized sounds when the user is involved in a noise cancellation context. At 301, an embodiment may activate a noise cancellation setting on a device. In the context of this application, the device may be virtually any device that affects a user's auditory senses. For simplicity purposes, throughout the remainder of this application the device may refer to noise cancelling headphones and/or a noise cancelling headset worn by a user.

In an embodiment, activation of the noise cancellation setting may effectively prevent all ambient noise from reaching the user. In an embodiment, activation of the noise cancellation setting may be manual (e.g., initiated by the user, etc.). For example, a user may toggle a button on their headset or activate the setting from another device associated with the headset (e.g., a smart phone paired with the headset, etc.). Additionally or alternatively, the noise cancellation setting may be automatically activated responsive to detection of a predetermined event (e.g., when the headset is turned on, when the headset is turned on, etc.). Additionally or alternatively, a noise cancellation setting may always be active on the device simply based on the nature of the device (e.g., active noise cancelling headphones, etc.).

At 302, an embodiment may record ambient audio in a user's environment. The audio may be recorded by a microphone that is integrally or operatively coupled to the headset. In the case of the latter, the ambient audio may be recorded by another device (e.g., an independent and dedicated microphone, a microphone integrated into another device, etc.) and may be transmitted (e.g., by a wired or wireless connection, etc.) to the headset.

In an embodiment, the recording of the ambient audio may be initiated upon detection that the noise cancellation setting is activated. In an embodiment, the ambient audio may be recorded until a predetermined event has been detected (e.g., until the headset is turned off, until the headset is taken off, until the noise cancellation setting is turned off, etc.). The recorded audio may be stored at an accessible storage location that may be present locally on the device and/or remotely on another device or server. In an embodiment, recoded audio may be stored in the database for a predetermined period of time (e.g., 10 minutes, 1 hour, 24 hours, etc.) or until it has become the oldest segment of unused audio.

At 303, an embodiment may determine whether an authorized sound is present in the recorded ambient audio. In the context of this application, an authorized sound may be a sound that a user desires to hear while the noise cancellation context is active. For example, the authorized sound may be a sound originating from a particular individual (e.g., a user's boss, a user's spouse, etc.). As another example, the authorized sound may be a sound associated with a particular event (e.g., a fire alarm, a phone call, a live media event such as a touchdown, etc.). In an embodiment, users may manually designate and change the sounds that they desire to become authorized sounds. Additionally or alternatively, certain sounds may be pre-designated by a manufacturer or programmer of the device (e.g., amber alerts, fire alarms, police or ambulance sirens, etc.).

The determination may be conducted by first employing one or more conventional audio analysis techniques to analyze the ambient audio and identify and differentiate unique sounds. For example, an embodiment may be able to identify and differentiate various machine-produced sounds from each other. As another example, an embodiment may be able to identify and differentiate various human-produced sounds. More particularly, an embodiment may be able to identify an individual that is producing the sounds. Thereafter, an embodiment may compare each unique sound to a list of authorized sounds (e.g., stored at an accessible location, etc.) to determine whether there is a match. For example, an embodiment may determine whether audible characteristics of an identified sound and those of an authorized sound have a predetermined threshold level of similarity (e.g., 75 percent similarity, 90 percent similarity, etc.). Responsive to arriving at a positive determination, an embodiment may conclude that the identified sound is associated with the authorized sound.

Responsive to determining, at 303, that the recorded ambient audio does not comprise an authorized sound, an embodiment may, at 304, maintain the existing noise cancellation setting. Conversely, responsive to determining, at 303, that the recorded ambient audio comprises an authorized sound, an embodiment may, at 305, notify a user of the authorized sound.

In an embodiment, the notification may apprise the user of the presence of the authorized sound. For example, a user may receive a visual or audible notification alerting them that an authorized sound has just been detected (e.g., a predetermined noise associated with authorized sound detection, a message displayed on a screen of a device a user is interacting with, etc.). In an embodiment, the notification may be transmitted a single time or, alternatively, may be transmitted multiple times. For example, the notification may be transmitted during the entire time that the authorized sound is detected. Responsive to determining that the authorized sound is no longer present in the ambient audio, an embodiment may cease provision of the notification.

In an embodiment, the notification may be associated with the replaying of the authorized sound to the user. In this situation, an embodiment may access the recorded ambient audio that comprises the authorized sound and thereafter automatically, without any additional user input, replay it to the user (e.g., through the user's headset, etc.). In an embodiment, the replaying of the authorized sound may be on a slight delay. The magnitude of the delay may vary between devices and may at least be dependent upon the capabilities of the user's device. A non-limiting practical example implementation of the foregoing concepts may be as follows: User A may be at work and wearing a noise cancellation headset. User A may desire to block all office sounds except those originating from his boss. Accordingly, while the headset is worn all office noise (e.g., chatter occurring between User A's co-workers, telephone sounds, printer sounds, etc.) is blocked. However, if User A's boss provides the request "User A, come to the conference room for a meeting", then, once detected, this statement may be replayed to User A.

In an embodiment, a predetermined amount of the ambient audio not associated with the authorized sound may also be replayed to the user along with the authorized sound. For example, the replay may include 5 seconds of ambient audio that occurs prior to the authorized sound. The purpose of such an embodiment may be to provide the user with some context regarding the authorized sound. For example, all audio detected from a user's spouse may be considered authorized. If the user's spouse provided the request, "can you get that?" the user would be apprised of the request but may not know what the deictic word (i.e., "that") refers to without receiving some additional context.

The various embodiments described herein thus represent a technical improvement to conventional methods of apprising users of desired messages while they are in a noise cancellation context. Using the techniques described herein, an embodiment may activate a noise cancellation setting and record ambient audio in a user's environment. An embodiment may then determine whether an authorized sound is detected in the recorded ambient audio and, responsive to determining that it is, an embodiment may notify a user of this authorized sound. For example, an embodiment may replay the authorized sound to the user. Such a method may prevent unwanted noise from reaching the user while still apprising them of sounds they desire to hear.

As will be appreciated by one skilled in the art, various aspects may be embodied as a system, method or device program product. Accordingly, aspects may take the form of an entirely hardware embodiment or an embodiment including software that may all generally be referred to herein as a "circuit," "module" or "system." Furthermore, aspects may take the form of a device program product embodied in one or more device readable medium(s) having device readable program code embodied therewith.

It should be noted that the various functions described herein may be implemented using instructions stored on a device readable storage medium such as a non-signal storage device that are executed by a processor. A storage device may be, for example, a system, apparatus, or device (e.g., an electronic, magnetic, optical, electromagnetic, infrared, or semiconductor system, apparatus, or device) or any suitable combination of the foregoing. More specific examples of a storage device/medium include the following: a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a storage device is not a signal and "non-transitory" includes all media except signal media.

Program code embodied on a storage medium may be transmitted using any appropriate medium, including but not limited to wireless, wireline, optical fiber cable, RF, et cetera, or any suitable combination of the foregoing.

Program code for carrying out operations may be written in any combination of one or more programming languages. The program code may execute entirely on a single device, partly on a single device, as a stand-alone software package, partly on single device and partly on another device, or entirely on the other device. In some cases, the devices may be connected through any type of connection or network, including a local area network (LAN) or a wide area network (WAN), or the connection may be made through other devices (for example, through the Internet using an Internet Service Provider), through wireless connections, e.g., near-field communication, or through a hard wire connection, such as over a USB connection.

Example embodiments are described herein with reference to the figures, which illustrate example methods, devices and program products according to various example embodiments. It will be understood that the actions and functionality may be implemented at least in part by program instructions. These program instructions may be provided to a processor of a device, a special purpose information handling device, or other programmable data processing device to produce a machine, such that the instructions, which execute via a processor of the device implement the functions/acts specified.

It is worth noting that while specific blocks are used in the figures, and a particular ordering of blocks has been illustrated, these are non-limiting examples. In certain contexts, two or more blocks may be combined, a block may be split into two or more blocks, or certain blocks may be re-ordered or re-organized as appropriate, as the explicit illustrated examples are used only for descriptive purposes and are not to be construed as limiting.

As used herein, the singular "a" and "an" may be construed as including the plural "one or more" unless clearly indicated otherwise.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

What is claimed is:

1. A method, comprising:

activating, on an information handling device, a noise cancelling setting;

recording, using a microphone associated with the information handling device, ambient audio;

determining, using a processor, whether an authorized sound is present in the recorded ambient audio; and notifying, responsive to determining that an authorized sound is present in the recorded ambient audio, a user of the authorized sound, wherein the notifying comprises replaying the authorized sound to the user and wherein the replaying comprises replaying a predetermined portion of the ambient audio occurring prior to the authorized sound.

2. The method of claim 1, wherein the recording comprises continually recording responsive to detecting that the noise cancelling setting is activated.

3. The method of claim 1, wherein the determining comprises identifying a sound in the ambient audio and comparing the sound to a list of authorized sounds in an accessible database.

4. The method of claim 3, wherein the determining further comprises determining that the sound is the authorized sound responsive to identifying a match between the sound and a stored sound in the list.

5. The method of claim 1, wherein the authorized sound is a sound produced by an authorized individual.

6. The method of claim 1, wherein the authorized sound is a sound associated with an authorized event.

7. The method of claim 1, wherein the information handling device is a noise-cancelling headset.

8. The method of claim 1, wherein the replaying comprises automatically replaying without additional user input.

9. An information handling device, comprising:

a microphone;

a processor;

a memory device that stores instructions executable by the processor to:

activate a noise cancelling setting;

record, using the microphone, ambient audio;

determine whether an authorized sound is present in the recorded ambient audio; and notify, responsive to determining that the authorized sound is present in the recorded ambient audio, a user of the authorized sound, wherein the notifying comprises replaying the authorized sound to the user and wherein the replaying comprises replaying a predetermined portion of the ambient audio occurring prior to the authorized sound.

10. The information handling device of claim 9, wherein the instructions executable by the processor to record comprise instructions executable by the processor to continually record responsive to detecting that the noise cancelling setting is activated.

11. The information handling device of claim 9, wherein the instructions executable by the processor to determine comprise instructions executable by the processor to identify a sound in the ambient audio and compare the sound to a list of authorized sounds in an accessible database.

12. The information handling device of claim 11, wherein the instructions executable by the processor to determine further comprise instructions executable by the processor to determine that the sound is the authorized sound responsive to identifying a match between the sound and a stored sound in the list.

13. The information handling device of claim 9, wherein the authorized sound is a sound produced by an authorized individual.

14. The information handling device of claim 9, wherein the authorized sound is a sound associated with an authorized event.

15. The information handling device of claim 9, wherein the information handling device is a noise-cancelling headset.

16. A product, comprising:

a storage device that stores code, the code being executable by a processor and comprising:

code that activates a noise cancelling setting;

code that records ambient audio;

code that determines whether an authorized sound is present in the recorded ambient audio; and code that notifies, responsive to determining that the authorized sound is present in the recorded ambient audio, a user of the authorized sound, wherein the code that notifies comprises code that replays the authorized sound to the user and wherein the code that replays comprises code that replays a predetermined portion of the ambient audio occurring prior to the authorized sound.

* * * * *